US007748058B2

(12) United States Patent
Steitle

(10) Patent No.: US 7,748,058 B2
(45) Date of Patent: Jul. 6, 2010

(54) CLOTHING SYSTEM HAVING PANTS AND INTERCHANGEABLE CUFFS

(76) Inventor: Maureen Steitle, 4632 Driftwood, Frisco, TX (US) 75034

( * ) Notice: Subject to any disclaimer, the term of this patent is extended or adjusted under 35 U.S.C. 154(b) by 0 days.

(21) Appl. No.: 11/620,899

(22) Filed: Jan. 8, 2007

(65) Prior Publication Data

US 2007/0118957 A1 May 31, 2007

Related U.S. Application Data

(63) Continuation-in-part of application No. 11/080,059, filed on Mar. 15, 2005, now abandoned.

(60) Provisional application No. 60/553,198, filed on Mar. 15, 2004.

(51) Int. Cl.
*A41D 27/08* (2006.01)

(52) U.S. Cl. ..... 2/244; 2/232; 2/269

(58) Field of Classification Search ..... 2/269, 2/227, 228, 244, 919, 232, 123
See application file for complete search history.

(56) References Cited

U.S. PATENT DOCUMENTS 0,208,817 A 10/1878 Hedges et al.
319,477 A * 6/1885 Gandil ..... 2/47
0,611,241 A 9/1898 Fellows
706,235 A * 8/1902 Herman ..... 2/211
0,864,684 A 8/1907 Pierce
1,023,864 A * 4/1912 Miller ..... 2/232
1,263,743 A 4/1918 Cooper
1,326,472 A 12/1919 Berman
1,453,779 A 5/1923 Altenburg
2,111,945 A 3/1938 Segelin et al.
2,227,214 A * 12/1940 Bisberg ..... 2/73
2,274,382 A * 2/1942 Richman ..... 2/70
2,382,907 A 8/1945 Persin
2,428,158 A 9/1947 Hermer
2,451,364 A 10/1948 Spector
2,677,829 A * 5/1954 Herman et al. ..... 2/232
2,688,136 A 9/1954 Freedman
2,822,596 A * 2/1958 Aaskov ..... 24/507
2,857,688 A 10/1958 Haase
2,885,682 A 5/1959 Koenig
2,997,718 A 8/1961 Jacobs
3,266,057 A * 8/1966 Phelps ..... 2/227
3,555,568 A 1/1971 Humphrey
3,701,166 A 10/1972 Lindblom
3,708,804 A 1/1973 Santos
3,722,001 A * 3/1973 Bailey ..... 2/269
4,149,275 A * 4/1979 Sanchez ..... 2/269
4,215,435 A 8/1980 Miele
4,232,402 A * 11/1980 Roche ..... 2/93
4,249,267 A 2/1981 Voss
4,602,389 A * 7/1986 Brown ..... 112/475.13
4,939,794 A 7/1990 Aronson (Continued)

*Primary Examiner*—Alissa L Hoey

(57) ABSTRACT

A clothing system includes a set of first pants having a corresponding set of first cuffs and includes a second of second pants having a corresponding set of second cuffs. The sets of pants have different size ranges, but each set has the same outside circumference on the legs of the pants for that set. Each of cuffs in a set has the same inside circumference that will fit the outside circumference for the legs of the corresponding set of pants. Fasteners on the inside circumferences of the cuffs are used to attach and hold the cuffs to fasteners on the outside circumference of the pant legs.

20 Claims, 4 Drawing Sheets

U.S. PATENT DOCUMENTS 5,006,393 A 4/1991 Isoe
5,067,177 A * 11/1991 Binder ..... 2/239
5,070,544 A 12/1991 Aliberti et al.
5,088,128 A * 2/1992 Kape ..... 2/269
5,097,537 A * 3/1992 Ewing ..... 2/409
5,173,965 A 12/1992 Panner
5,416,928 A 5/1995 Koenig
5,608,915 A * 3/1997 Libit ..... 2/228
5,758,671 A * 6/1998 Thim ..... 132/273
5,953,759 A * 9/1999 Bozzini ..... 2/409
D418,633 S 1/2000 Ruth
6,105,173 A * 8/2000 Brown ..... 2/239
6,209,141 B1 * 4/2001 Adeli ..... 2/239
6,360,372 B2 3/2002 Oster
6,408,438 B1 6/2002 McKee
6,611,964 B2 * 9/2003 Lipsett et al. ..... 2/227
6,665,876 B1 12/2003 Newman
6,968,573 B2 * 11/2005 Silver ..... 2/227
D528,743 S 9/2006 MacMillan
7,181,774 B2 * 2/2007 Silver ..... 2/227
7,231,671 B2 * 6/2007 Allen ..... 2/227
D554,827 S * 11/2007 Vaughn ..... D2/744
2003/0221244 A1 12/2003 Liddell
2004/0040068 A1 * 3/2004 Silver ..... 2/227
2005/0044610 A1 3/2005 Grimes
2005/0198724 A1 * 9/2005 Steitle et al. ..... 2/244
2006/0162040 A1 * 7/2006 Lee ..... 2/71
2006/0218698 A1 * 10/2006 Toyne ..... 2/231
2006/0277660 A1 12/2006 MacMillan
2007/0089456 A1 * 4/2007 Rose et al. ..... 63/21
2007/0118957 A1 * 5/2007 Steitle ..... 2/69
2007/0214547 A1 * 9/2007 Mullen ..... 2/227
2007/0271683 A1 * 11/2007 McCrary et al. ..... 2/244

* cited by examiner

CLOTHING SYSTEM HAVING PANTS AND INTERCHANGEABLE CUFFS

CROSS-REFERENCE TO RELATED APPLICATIONS

This is a continuation-in-part of U.S. patent application Ser. No. 11/080,059, filed Mar. 15, 2005, which is incorporated herein by reference and which claims the benefit of U.S. Provisional Application Ser. No. 60/553,198, filed Mar. 15, 2004.

FIELD OF THE INVENTION

The present invention generally relates to an interchangeable and removable attachment for use on the hemline of any garment, such as a pant, skirt, sleeve, collar, or short and relates more particularly to a clothing system having pants and interchangeable cuffs.

BACKGROUND OF THE INVENTION

Various fashion styles have featured decorated hemlines. The decorated hemlines range from simple fabrics to fancy beaded designs permanently attached to the hem of the garments. While consumers may enjoy the look of the garment, they are presented several challenges. Cleaning a garment that has a decorative hemline offers one challenge to consumers. If the decorative hemline is not elaborate, the hemline can be washed with the garment. If the decorative hemline is beaded or has other delicate or intricate decoration, however, the garment must be dry-cleaned. Often, the decorative hemline can be damaged in the dry-cleaning process. Once damaged, the garment is often not repairable and hence not wearable. In addition, many decorative accessories, such as those made with feathers or paper, could prevent conventional cleaning of the garment. Versatility of the garment offers another challenge for the consumer. Consumers are very limited with their styling options when purchasing a garment with a decorative hemline. Purchasing several pair of decorative hemline garments can become cost prohibitive.

The present invention of the interchangeable decorative hemline addresses one or more of these challenges.

SUMMARY OF THE DISCLOSURE

In one embodiment, an interchangeable hemline for a hem of a garment includes a decorative strip, a durable strip, a first fastener, and a second fastener. The decorative strip has an inside surface and has a length for substantially fitting around the hem of the garment. The durable strip is attached or sewn to the inside surface of the decorative strip. The durable strip forms a pull-tab that extends beyond one end of the decorative strip. The first fastener is attached or sewn to the durable strip, and the second fastener is attached or sewn to the garment adjacent the hem. The first fastener mates with the second fastener to substantially hold the decorative strip to the hem of the garment. The pull-tab facilitates removal of the decorative strip from the garment and bears most of the pulling action when the first and second fasteners are unmated.

The first fastener is preferably a first strip of a VELCRO fastener, and the second fastener is preferably a second, corresponding strip of the VELCRO fastener. The first strip of the VELCRO fastener sewn to the durable strip is preferably narrower than the durable strip and is sewn preferably sewn adjacent an upper edge of the durable strip. In addition, the first strip of the VELCRO fastener is preferably narrower than the second strip of the VELCRO fastener sewn to the garment. In one embodiment, the durable strip is a strip of twill tape, and the pull-tab can be formed from an approximately half inch loop formed at one end of the twill tape. In another embodiment, the durable strip is a length of ribbon, and the pull tabs can be formed from free ends of the ribbon that extend beyond both ends of the decorative strip and that tie together.

The decorative strip decorates the hem of the garment by removably attaching to the hem of the garment with the first and second fasteners. The durable strip reinforces the decorative strip and the first fastener, and the pull-tab formed at one end of the durable strip facilitates removal of the decorative strip from the hem of the garment.

In another embodiment, a clothing system includes a set of first pants having a corresponding set of first cuffs and includes a second of second pants having a corresponding set of second cuffs. The sets of pants have different size ranges, but each set has the same outside circumference on the legs of the pants for that set. Each of cuffs in a set has the same inside circumference that will fit the outside circumference for the legs of the corresponding set of pants. Fasteners on the inside circumferences of the cuffs are used to attach and hold the cuffs to fasteners on the outside circumference of the pant legs. The cuffs of a set can be used interchangeably on each leg of the pants for that set regardless of what size the pants are in the range of sizes for that set of pants.

For example, the first pants can have a plurality of first sizes ranging from girl's pants size of 2T to 6X. Each leg of the first pants has the same, outside circumference of 12.5-inches adjacent the open end of the leg. In addition, each leg has a first fastener attached to the first outside circumference. The first fastener can be a mesh portion of a ¼-inch wide adhesive strip, such as VELCRO®, sewn to the leg. Each of the corresponding first cuffs for the set of first pants has an inside circumference and a second fastener attached to the first inside circumference. In one embodiment, for example, the first inside circumference can be approximately 13-inches. The second fastener on the cuffs can be a hooked portion of a ¼-inch wide adhesive strip, such as VELCRO®, sewn to the inside of the cuffs. The first inside circumference of the first cuffs fits over the first outside circumference of the legs of the first pants, and the second fasteners attach to the first fastener to hold the first cuffs on the legs of the first pants.

Similarly, for example, the set of second pants can have a plurality of second sizes ranging from girl's pants sizes of 7 to 14. Each leg of the second pants has the same, second outside circumference of approximately 15-inches adjacent the open end of the leg. In addition, each leg of the second pants has a third fastener attached to the second outside circumference. Each of the second cuffs has the same, second inside circumference and a fourth fastener attached to the second inside circumference. In one embodiment, for example, the second inside circumference for each of the second cuffs can be approximately 15.5-inches. The second inside circumference of the second cuffs fits over the second outside circumference of the legs of the second pants, and the fourth fasteners attach to the third fastener to hold the second cuffs on the legs of the second pants.

DETAILED DESCRIPTION

Figure 1:
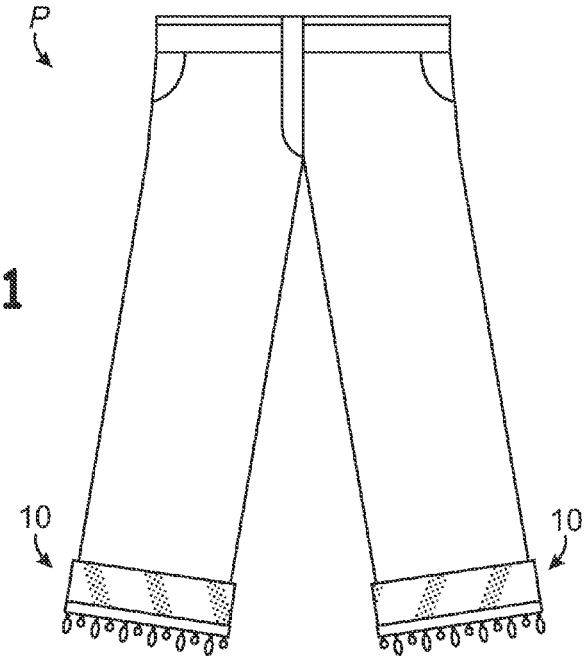
FIG. 1 shows a garment having an interchangeable hemline attached on the hem.

Referring to FIG. 1, a garment P is shown having an interchangeable hemline 10. In the present example, the garment P is a pair of pants having an interchangeable hemline 10 attached on the hems of each pant leg. In general, however, the interchangeable hemline 10 can be used on pants, skirts, shorts, dresses, or the like. In addition, the interchangeable hemline 10 can be used on the hems, sleeves, collars, or the like of the garments. For example, the interchangeable hemline 10 can be used on hems of pants as shown, on the lower hems or sleeves of jackets and shirts, or on the lower hems of skirts or dresses.

Figure 2A:
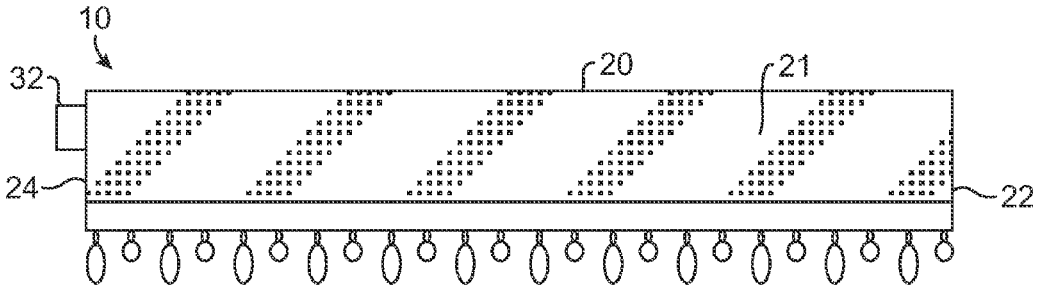
FIG. 2A shows one side of the interchangeable hemline.
Figure 2B:
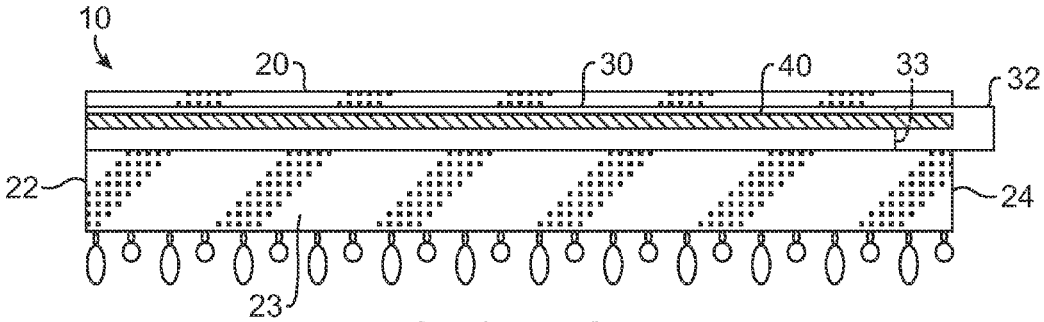
FIG. 2B shows another side of the interchangeable hemline having a durable strip and first fastener.

The interchangeable hemline 10 for the hem of the garment P includes a decorative strip 20 having first and second ends 22 and 24. The strip 20 attaches around the hem of the garment P so that the ends 22 and 24 meet together. The decorative strip 20 is generally a strip of decorative material. In the present example, the interchangeable hemline 10 is made out of the same material as the garment, although this is not strictly necessary. The interchangeable hemline 10 also has a decorative border attached to an upper edge of the decorative strip 20. In contrast, interchangeable hemline 10 of FIGS. 2A-B is made of a different decorative material. In addition, beads are attached to a lower edge of the decorative strip 20 and are intended to dangle from the interchangeable hemline 10 once attached to a garment. Therefore, the styling of the garment can easily be changed, updated, or lengthened using the interchangeable hemline 10.

A pull-tab 32, which will be described in more detail below, is accessible from the adjoining ends 22 and 24. The pull-tab 32 is used to remove the decorative strip 20 from the garment P. With the decorative strip 20 removed, the garment can easily be laundered. The decorative strip 20 is simply removed prior to each washing or dry-cleaning. The garment P can then be cleaned properly, and the decorative strip will not be damaged. Secondly, because the decorative strip 20 is removable and interchangeable, consumers can create a whole new look to the garment P by applying other removable decorative strips 20. In this way, a garment can be provided with a different aesthetic look by applying a different decorative strip 20.

Referring to FIGS. 2A-B, front and back sides of the interchangeable hemline 10 are shown. As noted above, the interchangeable hemline 10 includes the decorative strip 20 having first and second ends 22 and 24. In FIG. 2A, a front side or outside surface 21 of the hemline 10 is shown. This side 21 is visible when the interchangeable hemline 10 is attached to the garment. The pull tab 32 extends from one end 22 of the decorative strip 20. The pull tab 32 facilitates removal of the interchangeable hemline 10 from the garment. Hence, the durable strip 30 that forms the pull tab 32 bears most of the impact of the pulling action when removing the interchangeable hemline 10 from the garment.

In FIG. 2B, the back side or inside surface 23 of the interchangeable hemline 10 is shown. This side 21 is typically not visible when the hemline 10 is attached to the garment P. As seen in FIG. 2B, the interchangeable hemline 10 also includes a durable strip 30 and a first fastener 40. The durable strip 30 is narrower than the decorative strip 20 and is approximately the length of the first fastener 50, which fits around the circumference of the hem H as shown in FIG. 3.

As shown in FIG. 2B, the durable strip 20 is attached to the inside surface 23 of the decorative strip 20 near the top edge of the strip 20. Preferably, the durable strip 30 is sewn to the decorative strip 20, although other techniques, such as gluing or heat bonding, can be used. Preferably, the durable strip 30 is a strip of twill tape or other strong material for reinforcing the decorative strip 10 and the first fastener 40.

The durable strip 30 forms the pull tab 32 that extends beyond one end 22 of the decorative strip 20. The pull tab 32 can be formed from an approximately half inch loop of the durable strip 20. The end 33 of the loop for the pull tab 32 can be either sewn or glued in place. The first fastener 40 is attached to the durable strip 30 near the "top" edge of the strip 30. Preferably, the first fastener 40 is a first strip of a VELCRO® fastener. In addition, the first fastener 40 is preferably sewn both to the durable strip 30 and to the decorative strip 20, although other techniques can be used.

Figure 3:
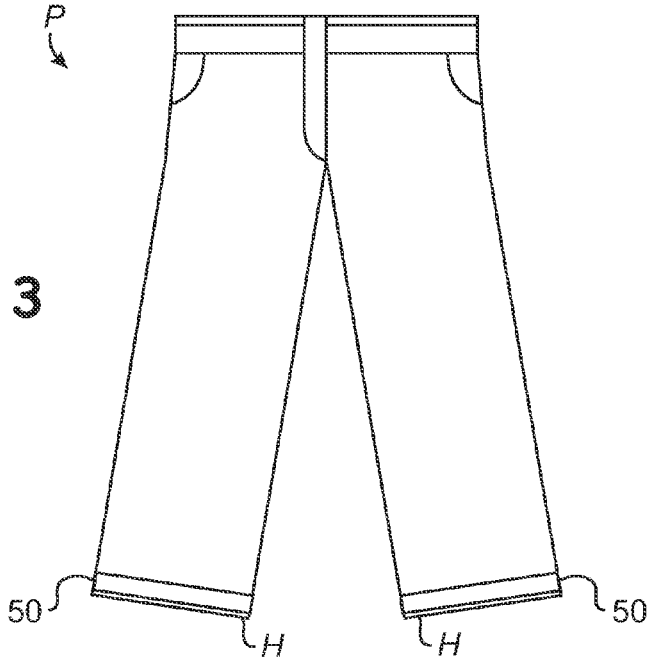
FIG. 3 shows the garment having a second fastener of the interchangeable hemline attached to the hem of the garment.

Referring to FIG. 3, the garment P is shown without the decorative strip attached. The interchangeable hemline (10) also includes a second fastener 50 attached to the garment P adjacent the hem H. Preferably, the second fastener 50 is sewn directly onto the hem H of the garment P, although other techniques can be used. The second fastener 50 is intended to mate with the first fastener 40 shown in FIG. 2B. Therefore, the second fastener is preferable a second, corresponding strip of VELCRO® capable of mating with the first fastener 40.

Figure 4A:
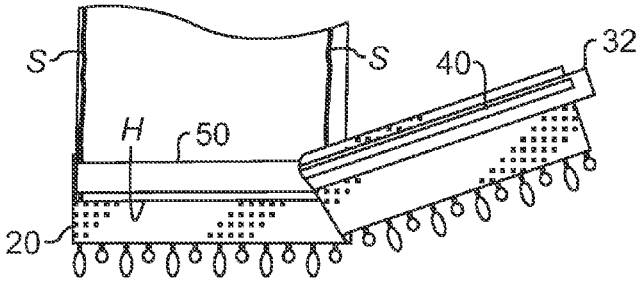
FIGS. 4A-4B shows various stages of attaching or removing the interchangeable hemline to the hem of the garment.
Figure 4B:
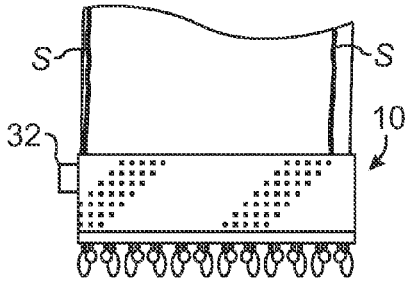

Referring to FIGS. 4A-4B, the interchangeable hemline 10 is shown in various stages of attaching to the hem H of the garment P. To attach the decorative strip 20 to the garment P, the first fastener 40 is mated with the second fastener 50 to substantially hold the decorative strip 20 to the hem H of the garment P. For example, one end 22 of the decorative strip 20 is first attached to the hem H of the garment P. On some garments P, it may be preferred to align the end 22 of the strip 20 with the seam S of the garment P. In this way, the decorative strip 20 may not overly stiffen the hem that it is attached to and may keep the hem H somewhat flexible at the seam S. For example, it may be preferred on pants that the ends 22 and 24 of the decorative strip 20 be aligned with the inside seam S of the pant leg.

With one end 22 attached to the hem H, the fasteners 40 and 50 are mated together around the hem H of the garment P as successively shown in FIGS. 4A-4B, until the other end 24 of the decorative strip 20 meets the first end 22 at the seam S of the garment P. Removal the decorative strip 20 is the reverse of FIGS. 4A-4B. Removal begins with holding the garment P, then pulling the pull tab, and separating the first and second fasteners 40 and 50 around the hem H.

As best shown in FIG. 4A, the first fastener or strip of VELCRO® 40 sewn to the durable strip 30 is narrower than the second fastener or strip of VELCRO® 50 sewn to the hem H of the garment P. Although the first and second fasteners 40 and 50 have been shown as the two mating portions of a VELCRO® fastener, it will be apparent that other devices, such as buttons, hooks and eyes, snaps, or the like can also be used.

Preferably, the second fastener 50 is the portion of VELCRO® having a mesh, and the first fastener 40 is the portion of VELCRO® having a plurality of stiff hooks intended to engage the mesh of the second fastener 50. The second fastener 50 must be securely attached to the garment P because this fastener 50 is intended to be washed with the garment P. Using the mesh portion of the VELCRO® fastener for the second fastener 50 on the hem H of the garment P may prevent other garments from sticking to the second fastener 50 when laundering the garment P with other clothing.

Figure 5:
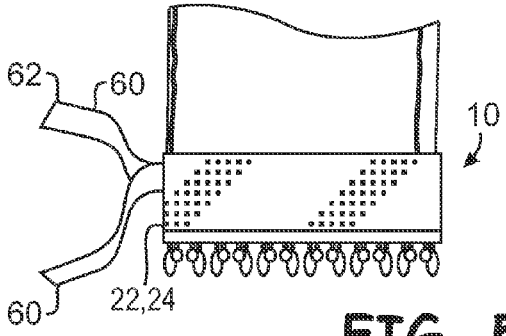
FIG. 5 shows another embodiment of an interchangeable hemline attached on the hem of a garment.

Referring to FIG. 5, another embodiment of an interchangeable hemline 10 is shown attached on the hem of a garment. The present embodiment of the interchangeable hemline 10 is essentially similar to other embodiments disclosed herein except that the present embodiment uses a ribbon 60 (rather than twill tape) as the durable strip attached to the decorative strip 20. The ribbon 60 is attached to the decorative strip 20 in a similar fashion as the twill tape disclosed above. In addition, the fastener (not shown) is similarly attached to the ribbon in a similar fashion as disclosed above.

The length of the ribbon is greater than that of the decorative strip 20 so that free ends 62 and 64 of the ribbon 60 form pull tabs extending beyond both ends 22, 24 of the decorative strip 20. Acting as pull tabs, the free ends 62 and 64 facilitate removal of the interchangeable hemline 10 from the garment. Hence, the ribbon 60 bears most of the impact of the pulling action when removing the interchangeable hemline 10 from the garment. In addition, the free ends 62 and 64 tie together when the interchangeable hemline 10 is attached to the garment. For example, the free ends 62 and 64 can be tied into a bow for decoration and for keeping the interchangeable hemline 10 attached to the garment.

Figure 6:
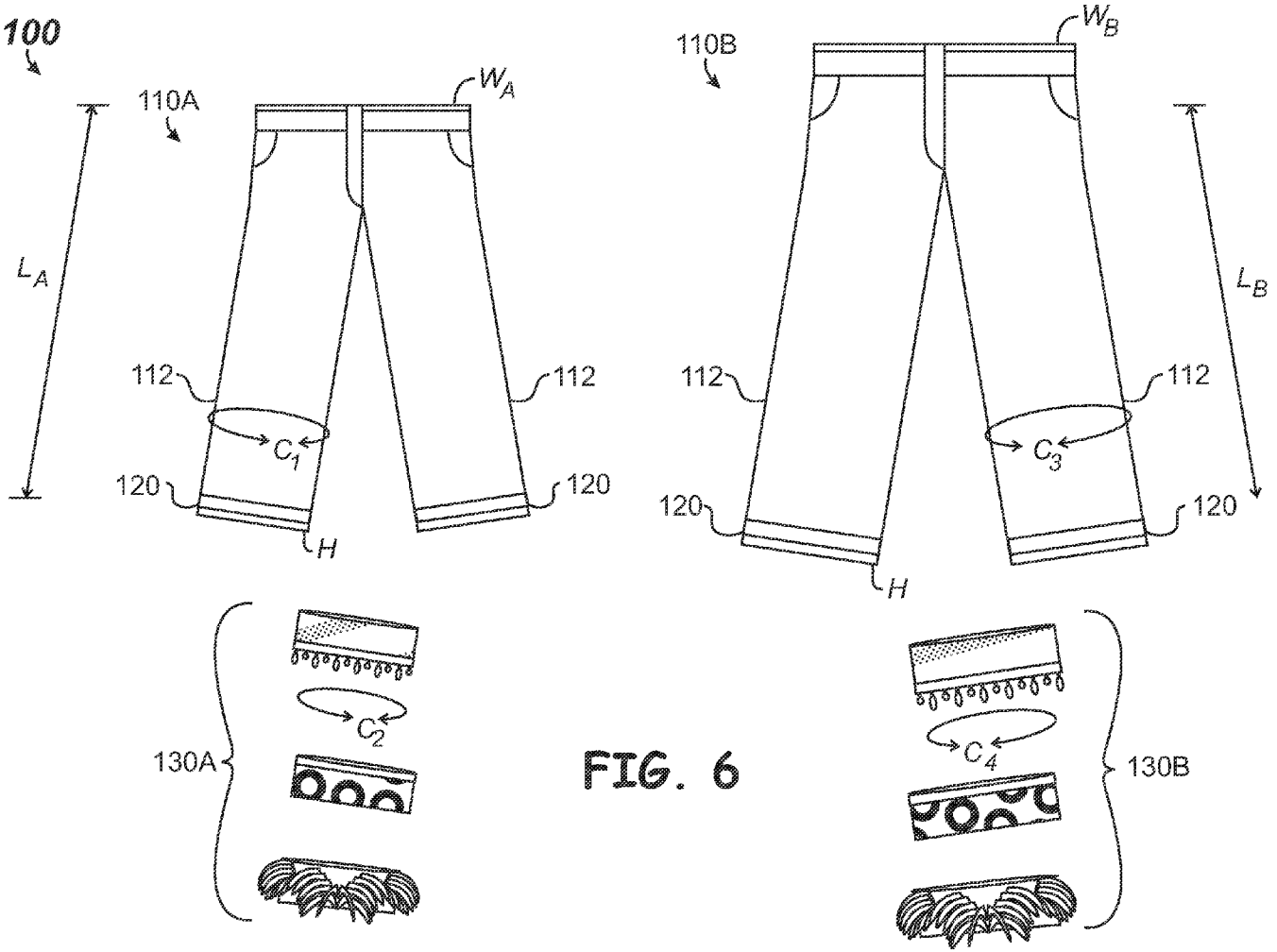
FIG. 6 shows one embodiment of a clothing system having pants and interchangeable cuffs.

FIG. 6 shows one embodiment of a clothing system 100 having interchangeable clothing items. The clothing system 100 has a plurality of sets of garments 110A-B having different sizes. In the present embodiment, the garments 110A-B are pants having different sizes. For example, a first set of pants 110A has a first set of sizes ranging from 2T to 6X for girls, and a second set of pants 110B has a second set of sizes ranging from 7 to 14 for girls. The waist size $W_A$ and length $L_A$ for the first set of pants 110A vary based on standard measurement for girl's pants sizes ranging from 2T to 6X, and the waist size $W_B$ and length $L_B$ for the first set of pants 110B likewise vary based on the standard measurements for girl's pants sizes ranging from 7 to 14.

However, the pant legs 112 of both sets of pants 110A-B have preconfigured outside circumferences $C_1$, $C_3$ that are not necessarily commensurate with standard size measurements. In particular, the first set of pants 110A has approximately the same outside circumference $C_1$ of about 12½-inches for each size ranging from 2T to 6X. Similarly, the first set of pants 110B has approximately the same outside circumference $C_3$ of about 15-inches for each size ranging from 7 to 14.

The clothing system 100 also includes a plurality of interchangeable hemlines or cuffs 130A-B. A first set of cuffs 130A can be used interchangeably with the first set of pants 110A, and second set of cuffs 130B can be used interchangeably with the second set of pants 110B. As before, the interchangeable cuffs 130 can attach to fastener strips 120 sewn around the outside circumference of each pant leg 112 near its end. The fastener strips 120 are preferably ¼-inch wide strips of the mesh portion of VELCRO®. Although not shown in FIG. 6, each interchangeable cuff 130 has a corresponding fastener strip (not shown) on its inside circumference $C_2$, $C_4$ for attaching to one of the fastener strips 120 on the pant legs 112.

In one embodiment, the interchangeable cuffs 130A-B can be substantially similar to the previous embodiments of interchangeable hemlines disclosed above. In the present embodiment as shown in FIG. 6, the interchangeable cuffs 130A-B are preferably formed or sewn into a closed, cylindrical shape so they can be slipped onto the hems H of the pant legs 112 and attach to the fastener strips 120.

The first cuffs 130A have an inside circumference $C_2$ that is slightly greater than the outside circumference $C_1$ for the legs 112 of the first set of pants 110A. For thick fabric, such as jean denim, the inside circumferences $C_2$ of the cuffs 130A is preferably about ½-inch greater than the outside circumferences $C_1$ of the corresponding pant legs 112. Thinner fabrics may require less of a difference in the circumferences $C_1$ and $C_2$. Therefore, the inside circumference $C_2$ in one embodiment is about 13-inches for each first cuff 130A fitting sizes of denim pants ranging from 2T to 6A. In this way, each of the first cuffs 130A can be used interchangeably on the pant legs 112 of any of the pants 110A, regardless of which size the pants 110A have in the range of sizes (e.g., 2T to 6X). It should be noted that the actual circumferences $C_1$, $C_2$ can vary depending on the material used and the sewing techniques employed.

The second cuffs 130B have an inside circumference $C_4$ that is also slightly greater (about ½ inch for denim fabric) than the circumference $C_3$ for the legs 112 of the second pants 110B. Therefore, the inside circumference $C_4$ is about 15½-inches for each cuff 130B fitting sizes of denim pants ranging from 7 to 14. In this way, each of the second cuffs 130B can be used interchangeably on the pant legs 112 of any of the second pants 110B, regardless of which size the pants 110B have in the range of sizes (e.g., 7 to 14). It should be noted that the actual circumferences $C_4$ can vary depending on the material used and the sewing techniques employed.

Figure 7:
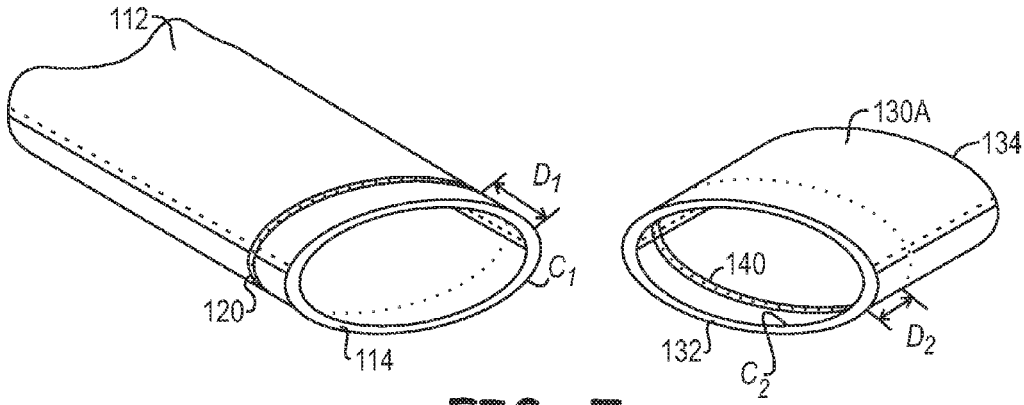
FIG. 7 shows a detail of a pant leg and an interchangeable cuff of the clothing system of FIG. 6.

FIG. 7 shows a detail of pant leg 112 and interchangeable cuff 130A of the clothing system 100 of FIG. 6. As shown, the pant leg 112 has the outside circumference $C_1$ near the edge 114. The first fastener strip 120 is attached around this outside circumference $C_1$ and is positioned at a distance $D_1$ from the edge 114. The distance $D_1$ is preferably about 0.5-inches for the first pants (110A of FIG. 6) and is the same for the second pants (110B of FIG. 6).

The interchangeable cuff 130A has the inside circumference $C_2$ near the edge 132. The second fastener strip 140 is attached around this inside circumference $C_2$ and is positioned at a distance $D_2$ from the edge 132. The distance $D_2$ is preferably about 0.5-inches for the first cuffs (130A of FIG. 6) and is the same for the second cuffs (130B of FIG. 6). This distance $D_2$ can enable extra material at the top of the cuff to hide the engagement of the fasteners 120 and 140.

Figure 8:
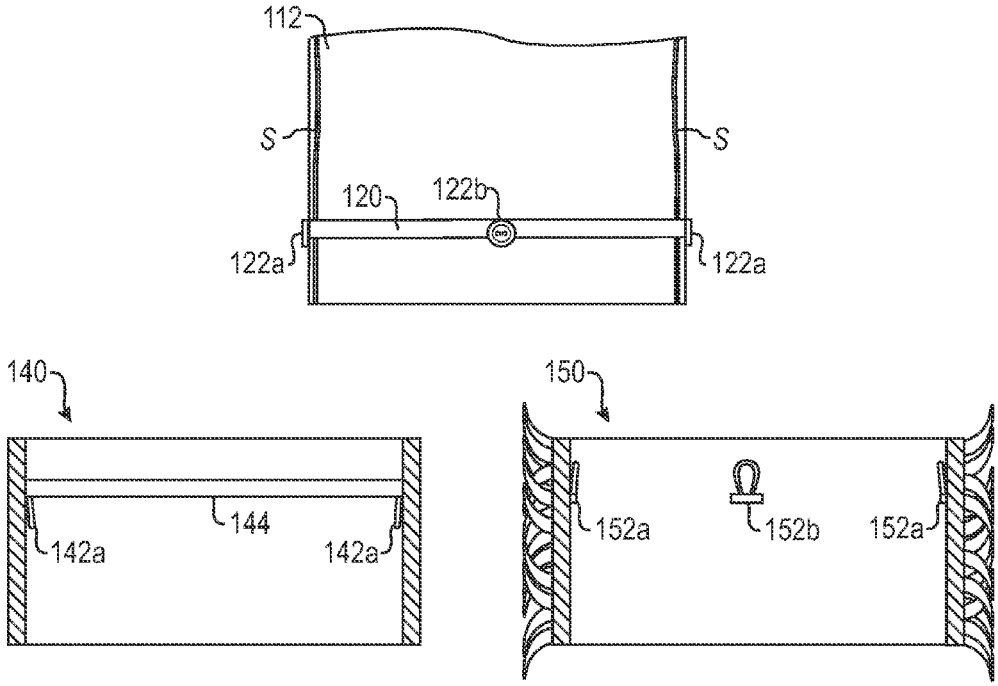
FIG. 8 shows additional embodiments of interchangeable cuffs relative to a pant leg for the clothing system of FIG. 6.

As seen in FIG. 7, the interchangeable cuff 130 attaches to the pant leg 112 using the first and second fastener strips 120 and 140. In additional embodiments, additional means can be used to attach cuffs to the pant legs. For example, FIG. 8 shows additional embodiments of interchangeable cuffs 150 and 160 that can attach to a pant leg 112 for the clothing system of FIG. 6. Accordingly, the cuffs 150 and 160 and pant leg 112 can be subject to the sizing requirements associated with the clothing system of FIG. 6.

Here, the pant leg 112 has a plurality of buttons 122 attached around the pant leg 112 in addition to the first fastener strip 120 discussed previously. Each of the buttons 122 is attached at the location of the first fastener strip 120 such that the top edge of the button 122 is preferably about level with the top edge of the first fastener strip 120. In addition, two end buttons 122*a* are preferably attached at the seams S of the pant leg 122, while two central buttons 122*b* are preferably attached about midway between the seams S.

A first type of cuff 150 is shown in FIG. 8 in a cut-away view. This cuff 150 has a fastener strip 152 for attaching to the fastener strip 120 on the pant leg 112 in a similar way to that discussed previously. In addition, the cuff 150 has two loops 154 at opposing sides of the inside surface for attaching to the two opposing buttons 122 on the pant leg 122, and preferably to the end buttons 122*a* at the seams S. The loops 154 are preferably sewn under the fastener strip 152 with the loop portions pointing downward. In this way, the fastener strip 152 on the cuff 150 can attach to the fastener strip 120 on the paint leg 112, while the loops 154 loop around the end buttons 122*a*.

A second type of cuff 160 is also shown in FIG. 8 in a cut-away view. This cuff 160 does not have a fastener strip for attaching to the fastener strip 120 on the pant leg 112. Instead, the cuff 160 has a plurality of loops 164 around the inside surface for attaching to the buttons 122 on the pant leg 122. The loops 154 can be sewn with the loop portions pointing upwards or downwards, but preferably upwards. This arrangement for attaching only loops 164 to buttons 122 is preferably used when the cuff 160 has a furry outside decoration 162.

Although two sets of pants 110A-B and cuffs 130A-B are discussed in the present embodiment of the clothing system 100 of FIGS. 5 through 8, other embodiments of the clothing system 100 can include more or fewer sets of pants and cuffs. In addition, although the sets in the embodiment of FIGS. 5 through 8 are divided into two girl's pants sizes ranging from 2T to 6X and from 7 to 14, other sizes ranges can be used, and ranges for women's pants can also be provided.

Modifications and equivalents of the disclosed concepts such as readily occur to one skilled in the art are intended to be included within the scope of the present invention.

What is claimed is:

1. A clothing system, comprising:

a set of first pants having a plurality of first pant sizes, the first pant sizes being different from one another and fitting different sized wearers, each of the first pants having first pant legs with first open ends, each of the first pant legs having a same first outside circumference adjacent the first open end and having a first fastener strip attached to the first outside circumference, wherein the first outside circumference remains fixed when worn and is the same for each of the first pants regardless of which of the different first pant sizes that the first pants have;

a set of first cuffs useable exclusively with the first pants, each of the first cuffs having a same first inside circumference and having a second fastener strip attached to the first inside circumference, wherein the first inside circumferences remains fixed when worn and fits over the first outside circumference of the first pant legs, and wherein the second fastener strips attach to the first fastener strips to hold the first cuffs on the first pant legs, wherein each of the first cuffs is useable with each of the first pants regardless of which of the different first pant sizes that the first pants have;

a set of second pants having a plurality of second pant sizes, the second pant sizes being different from one another and different from the first pant sizes and fitting different sized wearers, each of the second pants having second pant legs with second open ends, each of the second pant legs having a same second outside circumference adjacent the second open end and having a third fastener strip attached to the second outside circumference, wherein the second outside circumference remains fixed when worn and is the same for each of the second pants regardless of which of the different second pant sizes that the second pants have; and a set of second cuffs useable exclusively with the second pants, each of the second cuffs having a same second inside circumference and having a fourth fastener strip attached to the second inside circumference, wherein the second inside circumference remains fixed when worn and fits over the second outside circumference of the second pant legs, and wherein the fourth fastener strips attach to the third fastener strips to hold the second cuffs on the second pant legs, wherein each of the second cuffs is useable with each of the second pants regardless of which of the different second pant sizes that the second pants have.

2. The clothing system of claim 1, wherein the first fastener strips each comprises a mesh portion of an adhesive strip sewn to the first outside circumference of the first pant leg.

3. The clothing system of claim 2, wherein the second fastener strips each comprise a hook portion of the adhesive strip sewn to the first inside circumference of the first cuff.

4. The clothing system of claim 1, wherein each of the first fastener strips is approximately 0.5-inches from the first open ends of the first pant legs, and wherein each of the second fastener strips is approximately 0.5-inches from an open end of the first cuffs.

5. The clothing system of claim 1, wherein the first pant sizes for the first pants comprise pants sizes for girls ranging from approximately 2T to approximately 6X.

6. The clothing system of claim 5, wherein the first outside circumference of the first pants is approximately 12.5-inches, and wherein the first inside circumference of the first cuffs is approximately 13-inches.

7. The clothing system of claim 1, wherein the second pant sizes for the second pants comprise pants sizes for girls ranging from approximately 7 to approximately 14.

8. The clothing system of claim 7, wherein the second outside circumference of the second pants is approximately 15-inches, and wherein the second inside circumference of the second cuffs is approximately 15.5-inches.

9. The clothing system of claim 1, wherein the first pant legs further comprise a plurality of buttons attached adjacent the first fastener strips.

10. The clothing system of claim 9, wherein the first cuffs further comprise at least two loops attached adjacent the second fastener strips for attaching to at least two of the buttons.

11. The clothing system of claim 9, further comprising a set of third cuffs, each of the third cuffs having a third inside circumference and having a plurality of loops attached to the third inside circumference, and wherein the third inside circumference fits over the first outside circumference of the first pant legs, and wherein the loops attach to the buttons to hold the third cuffs on the first pant legs.

12. The clothing system of claim 1, wherein each of the first cuffs is interchangeably attachable to any of the legs of the first pants regardless of the first pant size, and wherein each of the second cuffs is interchangeably attachable to any of the legs of the second pants regardless of the second pant size.

13. A clothing system, comprising:

first pants having first pant sizes, the first pant sizes being different from one another and fitting different sized wearers, each leg of the first pants having a same first outside circumference adjacent an open end and each having a first fastener attached to the first outside circumference;

first cuffs useable exclusively with the first pants, each having a same first inside circumference to fit over the first outside circumference of the legs of the first pants and having a second fastener to attach to the first fastener on the legs of the first pants, wherein the first inside and outside circumferences remain fixed when worn, wherein each of the first cuffs is useable with each of the first pants regardless of which of the different first pant sizes that the first pants have;

second pants having second pant sizes, the second pants being different from one another and different from the first sizes and fitting different sized wearers, each leg of the second pants having a same second outside circumference adjacent an open end and each having a third fastener attached to the second outside circumference; and second cuffs useable exclusively with the second pants, each having a same second inside circumference to fit over the second outside circumference of the legs of the second pants and each having a fourth fastener to attach to the third fastener on the leg of the second pants, wherein the second inside and outside circumferences remain fixed when worn, wherein each of the second cuffs is useable with each of the second pants regardless of which of the different second pant sizes that the second pants have.

14. The clothing system of claim 13, wherein the first fasteners each comprises a mesh portion of an adhesive strip sewn to the first outside circumference of the leg, and wherein the second fasteners each comprise a hook portion of the adhesive strip sewn to the first inside circumference of the first cuff.

15. The clothing system of claim 13, wherein the first pant sizes for the first pants comprise pants sizes for girls ranging from approximately 2T to approximately 6X, wherein the first outside circumference of the first pants is approximately 12.5-inches, and wherein the first inside circumference of the first cuffs is approximately 13-inches.

16. The clothing system of claim 13, wherein the second pant sizes for the second pants comprise pants sizes for girls ranging from approximately 7 to approximately 14, and wherein the second outside circumference of the second pants is approximately 15-inches, and wherein the second inside circumference of the second cuffs is approximately 15.5-inches.

17. The clothing system of claim 13, wherein the first pants further comprise a plurality of buttons attached adjacent the first fasteners, and the first cuffs further comprise at least two loops attached adjacent the second fastener strips for attaching to at least two of the buttons.

18. The clothing system of claim 17, further comprising third cuffs, each having a third inside circumference and having a plurality of loops attached to the third inside circumference, and wherein the third inside circumference fits over the first outside circumference of the first pants, and wherein the loops attach to the buttons to hold the third cuffs on the legs of the first pants.

19. The clothing system of claim 13, wherein each of the first cuffs is interchangeably attachable to any of the legs of the first pants regardless of the first pant size, and wherein each of the second cuffs is interchangeably attachable to any of the legs of the second pants regardless pf the second pant size.

20. A method of making an interchangeable system of clothing items, the method comprising:

making first pants having first pant sizes and having first pant legs, the first pant sizes being different from one another and fitting different sized wearers, the first pant legs having a same first outside circumference and having first fastener strips attached to the first outside circumference;

making first cuffs useable exclusively with the first pants, the first cuffs having a same first inside circumference to fit onto the first pant legs and having second fastener strips attached to the first inside circumference to attach to the first fastener strips, wherein the first inside and outside circumferences remain fixed when worn, wherein each of the first cuffs interchangeably attaches to any of the first pant legs regardless of the different first pant size of the first pants;

making second pants having second pant sizes and having second pant legs, the second pant sizes being different from one another and different from the first pant sizes and fitting different sized wearers, the second pant legs having a same second outside circumference and having third fastener strips attached to the second outside circumference; and making second cuffs useable exclusively with the second pants, the second cuffs having a same second inside circumference to fit onto the second pant legs and having fourth fastener strips attached to the second inside circumference to attach to the third fastener strips on the second pant legs, wherein the first inside and outside circumferences remain fixed when worn, wherein each of the second cuffs interchangeably attaches to any of the second pant legs regardless of the different second pant size of the second pants.

* * * * *